US010974374B2

(12) United States Patent
Rajotte

(10) Patent No.: US 10,974,374 B2
(45) Date of Patent: Apr. 13, 2021

(54) IMPACT DRIVER SCREW DRIVING DEVICE WITH DEPTH ADJUSTMENT

(71) Applicant: Jacques Rajotte, Whistler (CA)

(72) Inventor: Jacques Rajotte, Whistler (CA)

( * ) Notice: Subject to any disclaimer, the term of this patent is extended or adjusted under 35 U.S.C. 154(b) by 366 days.

(21) Appl. No.: 16/225,439

(22) Filed: Dec. 19, 2018

(65) Prior Publication Data

US 2020/0198103 A1 Jun. 25, 2020

(51) Int. Cl.
*B25B 23/00* (2006.01)
*B25B 21/00* (2006.01)

(52) U.S. Cl.
CPC ..... *B25B 23/0064* (2013.01); *B25B 21/00* (2013.01); *B25B 23/0035* (2013.01)

(58) Field of Classification Search
CPC .. B25B 23/0064; B25B 23/0035; B25B 21/00
See application file for complete search history.

(56) References Cited

U.S. PATENT DOCUMENTS

| | | | |
|---|---|---|---|
| 2,967,441 | A | 1/1961 | Miles |
| 3,767,218 | A | 10/1973 | Linthicum et al. |
| 4,287,923 | A | 9/1981 | Hornung |
| 4,647,260 | A | 3/1987 | O'Hara et al. |
| 4,753,142 | A | 6/1988 | Hornung |
| 5,188,378 | A | 2/1993 | Erienkeuser |
| 5,341,704 | A | 8/1994 | Klemm |
| 5,380,132 | A | 10/1995 | Parks |
| 5,601,387 | A | 2/1997 | Sanford et al. |
| 5,996,452 | A | 12/1999 | Chiang |
| 6,192,776 | B1 | 2/2001 | Leitner |
| 6,199,872 | B1 | 3/2001 | Hasan |
| 6,364,318 | B1 | 4/2002 | Bedi et al. |
| 6,520,509 | B1 | 2/2003 | Vasudeva et al. |
| 6,543,959 | B1 | 4/2003 | Jore |
| 6,637,755 | B2 | 10/2003 | Chen et al. |
| 6,758,116 | B2 * | 7/2004 | Kriaski ..... B25B 23/0064 173/13 |
| 6,912,932 | B2 | 7/2005 | Kriaski et al. |
| 6,931,967 | B1 | 8/2005 | Chang |
| 7,086,313 | B2 | 8/2006 | Cantlon |
| 7,175,185 | B2 | 2/2007 | Chen |
| 7,387,054 | B2 | 6/2008 | Rajotte |

(Continued)

OTHER PUBLICATIONS

Requisition issued by the Canadian Patent Office dated Dec. 17, 2019 against the corresponding Canadian patent application—4 pages.

(Continued)

*Primary Examiner* — David B. Thomas

(57) ABSTRACT

An impact driver screw driving device with depth adjustment has a floating sleeve that surrounds a screw driving mechanism. A floating sleeve spring provides a constant bias between a top of the floating sleeve and a top of the screw driving mechanism. A depth adjustment sleeve is threadedly connected to a lower end of the floating sleeve. The floating sleeve and the depth adjustment sleeve are free to rotate independently of the screw driving device so concussive force of the impact driver does not change a driven screw depth adjustment set by manually rotating the depth adjustment sleeve while gripping the floating sleeve.

20 Claims, 6 Drawing Sheets

(56) References Cited

U.S. PATENT DOCUMENTS

| | | | | |
|---|---|---|---|---|
| 7,565,854 | B2 * | 7/2009 | Chiang | B25B 15/001 279/75 |
| 7,607,871 | B1 | 10/2009 | Nelson | |
| 7,735,400 | B2 * | 6/2010 | Chen | B25B 23/0035 81/429 |
| 7,810,414 | B2 | 10/2010 | Hsu | |
| 7,823,483 | B2 | 11/2010 | Yamada | |
| 8,016,605 | B2 | 9/2011 | Montena et al. | |
| 8,287,547 | B2 | 10/2012 | Martin et al. | |
| 8,721,234 | B2 | 5/2014 | Santamarina et al. | |
| 8,876,444 | B1 * | 11/2014 | Chanturidze | B23B 51/104 408/191 |
| 9,174,285 | B2 * | 11/2015 | Chang | B25B 15/001 |
| 9,561,582 | B2 * | 2/2017 | Hsu | B25B 23/0064 |
| 9,566,695 | B2 * | 2/2017 | Rajotte | B25B 23/0035 |
| 9,764,452 | B2 * | 9/2017 | Koch | B25B 23/12 |
| 10,710,221 | B2 * | 7/2020 | Koch | B25B 23/10 |
| 10,828,755 | B2 * | 11/2020 | Nagel, III | B25B 23/0035 |
| 2002/0127070 | A1 | 9/2002 | Mawhinney | |
| 2014/0165794 | A1 * | 6/2014 | Chiang | B25B 23/12 81/451 |
| 2015/0122089 | A1 | 7/2015 | Rajotte | |
| 2016/0375565 | A1 | 12/2016 | Koch | |
| 2018/0126523 | A1 | 5/2018 | Rajotte et al. | |

OTHER PUBLICATIONS

EU application 19 212 461.8 Search report European Patent Office.
EU application 19 212 461.8 Examination report European Patent Office.

* cited by examiner

IMPACT DRIVER SCREW DRIVING DEVICE WITH DEPTH ADJUSTMENT

FIELD OF THE INVENTION

The present invention relates to a screw driving device and, in particular, an impact driver screw driving device with depth adjustment to adjustably control a depth to which a screw is driven into a work piece.

BACKGROUND OF THE INVENTION

Existing devices for driving screws using an impact driver are known, as characterized by Applicant's co-pending published United States Patent application number US/2018/0126523A1, published on May 10, 2018 entitled Screw Driving Device for Use With An Impact Driver. That device works extremely well for consistently driving screws to a predetermined depth determined by a length of a replaceable nose cone on the device.

However, it is well known that a device with adjustable screw depth control is desirable. It is also understood that the concussive force generated by impact drivers transmits to prior art depth adjusting mechanisms, causing those mechanisms to change depth settings as a screw is driven into a workpiece, which is most undesirable.

It is therefore an object of the invention to provide a screw driving device for an impact driver with a screw depth adjustment mechanism that will not change a depth setting to which it has been adjusted while screws are driven by the impact driver.

SUMMARY OF THE INVENTION

The invention therefore provides an impact driver screw driving device with depth adjustment, comprising: a screw driving mechanism that retains a screw bit for driving screws into a work surface; a floating sleeve that surrounds the screw driving mechanism; a floating sleeve spring that provides a constant bias between an upper end of the floating sleeve and an upper end of a hollow clutch sleeve of the screw driving mechanism; a depth control sleeve threadedly connected to a bottom end of the floating sleeve, the depth control sleeve having a bottom end with a passage through which the screw bit extends; and a clutch spring that constantly urges the screw driving mechanism to a drive position.

The invention further provides an impact driver screw driving device with depth adjustment, comprising: a screw driving mechanism that retains a screw bit for driving screws into a work surface, the screw driving mechanism comprising a drive shaft with a socket end received in a hollow clutch sleeve; a floating sleeve that surrounds the screw driving mechanism; a floating sleeve spring that provides a constant bias between an upper end of the floating sleeve and an upper end of the hollow clutch sleeve; a depth control sleeve threadedly connected to a bottom end of the floating sleeve, the depth control sleeve having a bottom end with a passage through which the screw bit extends; and a clutch spring captured between a clutch spring retainer clip received in a clutch spring retainer clip groove on the drive shaft and a top of the hollow clutch sleeve, the clutch spring constantly urging the screw driving mechanism to a drive position.

The invention yet further provides an impact driver screw driving device with depth adjustment, comprising: a screw driving mechanism that retains a screw bit for driving screws into a work surface, the screw driving mechanism comprising a drive shaft with a socket end received in a hollow clutch sleeve, the socket end of the drive shaft receiving and retaining the screw bit; a floating sleeve that surrounds the screw driving mechanism; a floating sleeve spring that provides a constant bias between an upper end of the floating sleeve and an upper end of the hollow clutch sleeve, the floating sleeve spring being retained in a top of the floating sleeve by a spring retainer washer and a washer retainer clip received in a retainer clip groove in the upper end of the floating sleeve; a depth control sleeve threadedly connected to a bottom end of the floating sleeve, the depth control sleeve having a bottom end with a passage through which the screw bit extends; and a clutch spring captured between a clutch spring retainer clip received in a clutch spring retainer clip groove on the drive shaft and a top of the hollow clutch sleeve, the clutch spring constantly urging the screw driving mechanism to a drive position.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

The invention provides an impact driver screw driving device with depth adjustment which has a floating sleeve that surrounds a screw driving mechanism that retains a screw bit. A floating sleeve spring provides a constant bias between a top of the floating sleeve and a top of the screw driving device. A depth adjustment sleeve is threadedly connected to a lower end of the floating sleeve. The floating sleeve and the depth adjustment sleeve are free to rotate independently of the screw driving device so concussive force of the impact driver does not change a driven screw depth adjustment setting. The driven screw depth adjustment setting is set by manually rotating the depth adjustment sleeve to one of a plurality of predetermined driven screw depth settings while gripping the floating sleeve to prevent rotation thereof.

Figure 1:
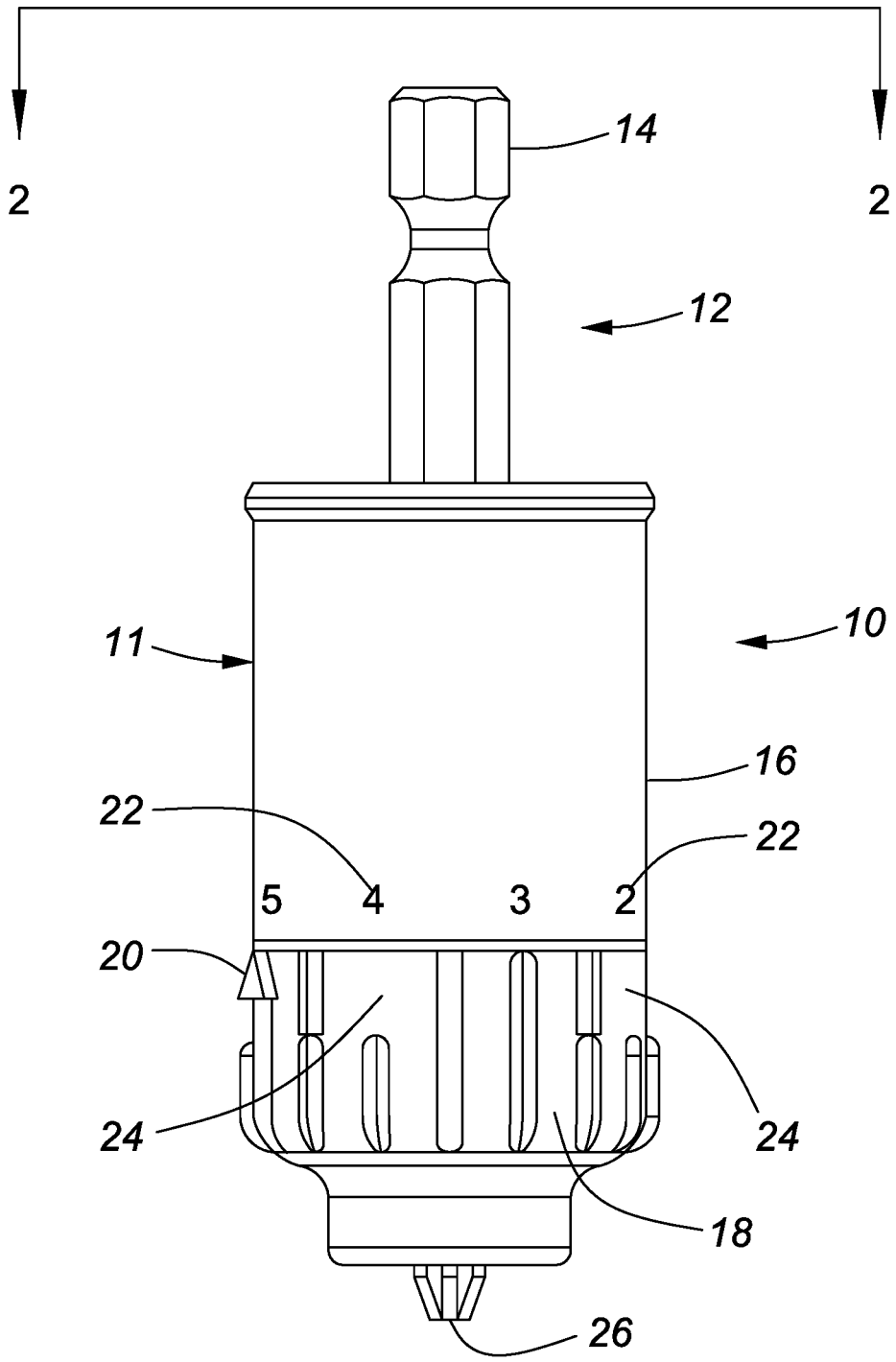
FIG. 1 is a side elevational view of an impact driver screw driving device with a depth adjustment mechanism in accordance with the invention.

FIG. 1 is a side elevational view of an impact driver screw driving device 10 with a depth adjustment mechanism 11 in accordance with the invention. The screw driving device 10 has a drive shaft 12 with a drive end 14 adapted to be engaged and driven by a portable electric impact driver (not shown), a hand tool that is well known in the art. A floating sleeve 16 surrounds the drive shaft 12 of a screw driving mechanism, which will be explained below with reference to FIGS. 4-6. A depth adjustment sleeve 18 is threadedly connected to a bottom end of the floating sleeve 16, as will be also explained below in more detail with reference to FIGS. 2 and 3. The depth adjustment sleeve 18 has a depth adjustment indicator 20 that indicates a current depth to which a screw is to be driven by the screw driving device 10. The depth adjustment indicator 20 aligns with one of a plurality of driven screw depth adjustment indexes 22 on the floating sleeve 16, as will be explained below with reference to FIG. 3. A plurality of depth adjustment lock tabs 24 lock the depth adjustment sleeve 18 at a current driven screw depth adjustment index 22. To change the driven screw depth adjustment, the depth adjustment sleeve 18 is manually rotated to a different depth adjustment index 22 by an operator of the impact driver screw driving device 10, which changes a depth to which a screw (not shown) is driven in a work piece (not shown) by a screw bit 26.

Figure 2:
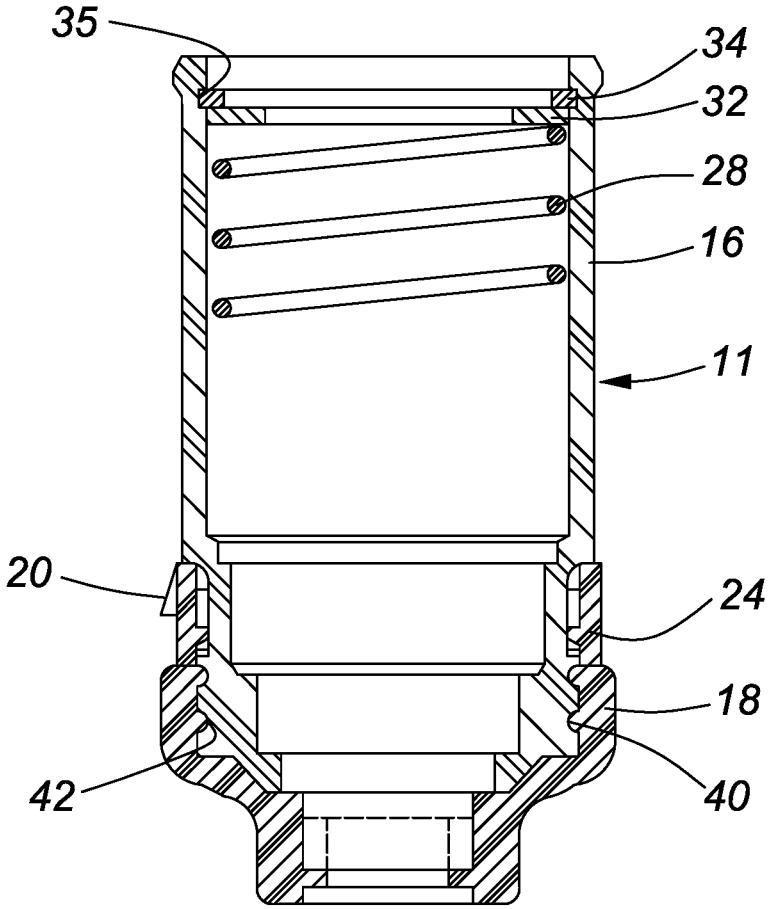
FIG. 2 is a cross-sectional view of the depth adjustment mechanism of the impact driver screw driving device taken along lines 2-2 of FIG. 1.

FIG. 2 is a cross-sectional view of the depth adjustment mechanism 11 of the impact driver screw driving device 10, taken along lines 2-2 of FIG. 1. A floating sleeve spring 28 provides a constant bias between an upper end of the floating sleeve 16 and an upper end of the screw driving mechanism 30 (see FIG. 4). A top of the floating sleeve spring 28 is retained by a spring retainer washer 32. This permits the floating sleeve 16 and the depth adjustment sleeve 18 to rotate freely with respect to the screw driving mechanism 30, so concussive force of the impact driver does not change the driven screw depth adjustment. The spring retainer washer 32 is retained within the floating sleeve 16 by a washer retainer clip 34 received in a retainer clip groove 35 in a top end of the floating sleeve 16. As can be seen, the depth adjustment sleeve 18 is rotatably secured on the lower end of the floating sleeve 16 by a male thread 40 on the lower end of the floating sleeve 16 that engages a female thread 42 within the depth adjustment sleeve 18.

Figure 3:
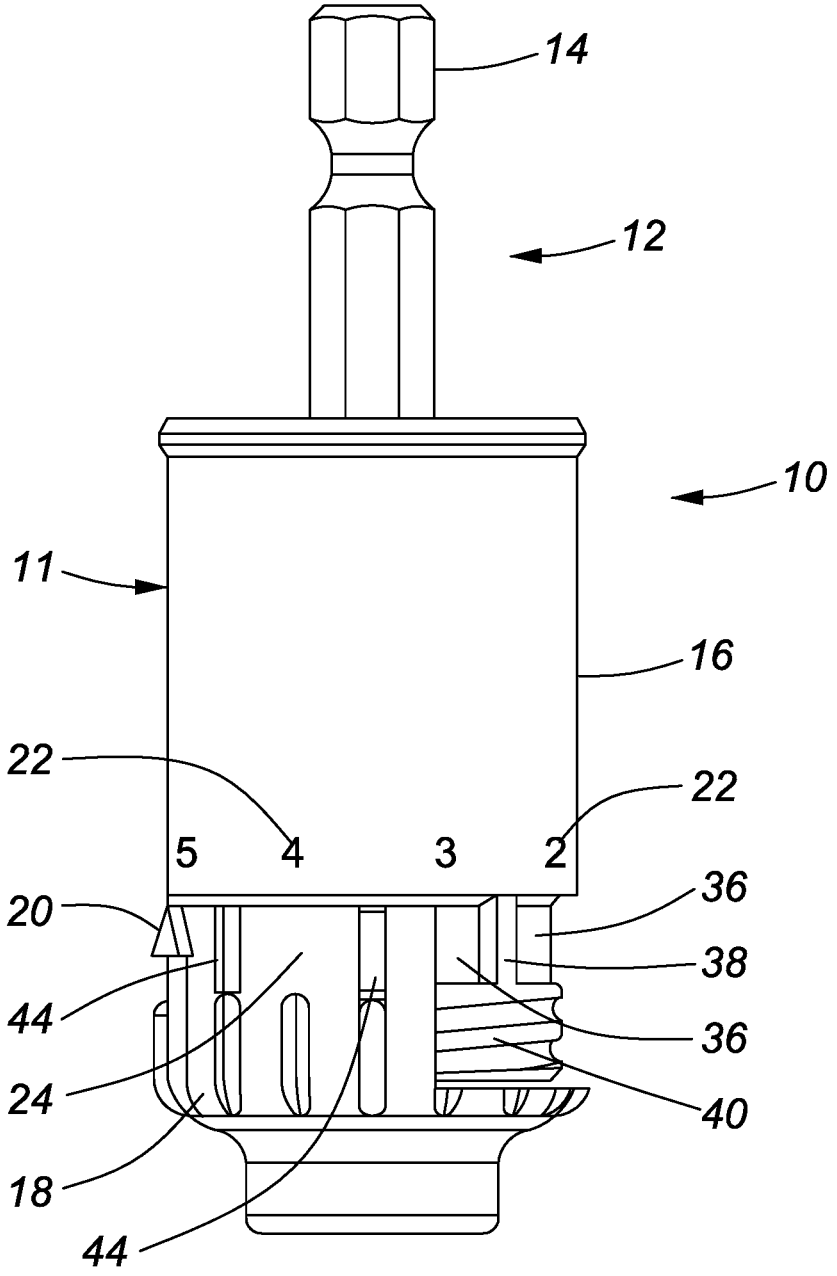
FIG. 3 is a side elevational view of the impact driver screw driving device showing a depth adjustment sleeve partially cut away to illustrate depth adjustment notches on a floating sleeve of the depth adjustment mechanism.

FIG. 3 is a side elevational view of the impact driver screw driving device 10 showing the depth adjustment sleeve 18 partially cut away to illustrate depth adjustment notches 36 on a floating sleeve 16 of the depth adjustment mechanism 11. The depth adjustment notches 36 are interleaved by depth adjustment ridges 38. The depth adjustment notches 36 are equally distributed around a perimeter of the floating sleeve 16, there being one depth adjustment notch 36 for each depth adjustment index 22 of the screw driving device 10. As explained above, the depth adjustment sleeve 18 is threadedly connected to the floating sleeve 16. In one embodiment, the male thread 40 and female thread 42 are arranged such that the depth adjustment mechanism 11 is at maximum depth setting when the complimentary male thread 40 and female thread 42 are fully engaged. To change a driven screw depth setting, the operator grips the floating sleeve 16 and the depth adjustment sleeve 18 and rotates the depth adjustment sleeve 18 in an appropriate direction with respect to the floating sleeve 16, forcing the depth adjustment lock tabs 24 over the respective depth adjustment ridges 38 until the depth adjustment indicator 20 points to a desired depth adjustment index 22. In one embodiment, depth adjustment sleeve slots 44 are provided to facilitate deflection of the depth adjustment lock tabs 24 as they are respectively forced over the respective depth adjustment ridges 38 during a change to a different depth adjustment index 22.

Figure 4:
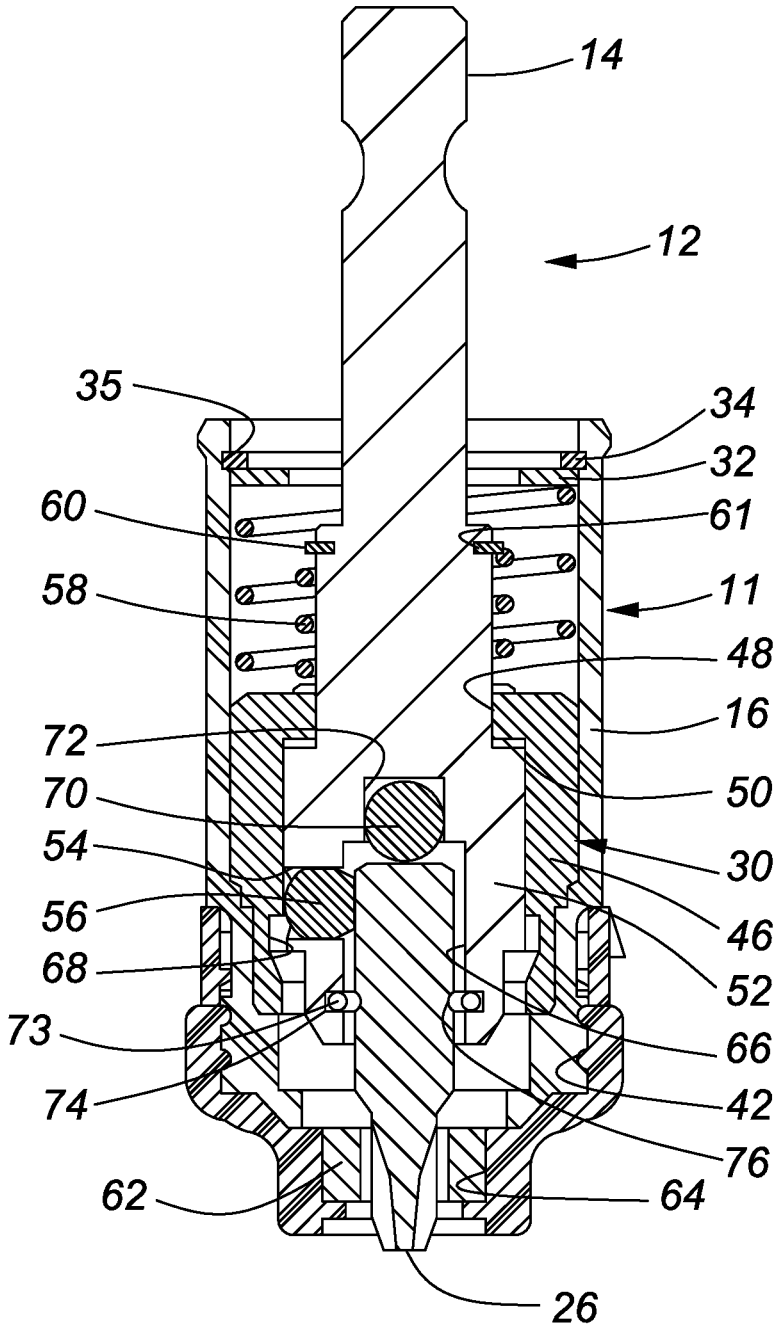
FIG. 4 is a cross-sectional view taken along lines 2-2 of FIG. 1 with the impact driver screw driving device in a screw driving position.

FIG. 4 is a cross-sectional view taken along lines 2-2 of FIG. 1 with the screw driving mechanism 30 of the impact driver screw driving device 10 in a screw driving position. In the screw driving position, the screw bit 26 rotates with the drive shaft 12 and is released from driving engagement with the drive shaft 12 when the screw driving mechanism 30 is in a clutched position, as will be explained below with reference to FIG. 5. The drive end 14 of the drive shaft 12 extends through a central passage 48 in a hollow clutch sleeve 46. A top of the central passage 48 extends inwardly to form a hollow clutch sleeve stop 50 sized to permit the drive end 14 of the drive shaft 12 to pass through, but not permit a socket end 52 of the drive shaft 12 to pass through. A plurality of radial bores 54 through the socket end 52 of the drive shaft 12 respectively house a clutch bearing 56. The clutch bearings 56 are described in detail in Applicant's above-referenced published co-pending U.S. patent application Ser. No. 15/344,807, filed on Nov. 7, 2016, the specification of which is incorporated herein by reference. In one embodiment there are 3 radial bores 54 spaced 120° apart on a radial plane. A flat inner end of the respective clutch bearings 56 engage flats on the hexagonal screw bit 26 in the drive position of the screw driving mechanism 30, so that the screw bit 26 rotates with the screw driving mechanism 30. The respective clutch bearings 56 collectively disengage from the screw bit 26 when the screw driving device 10 is in the clutched position, so that the screw bit 26 no longer rotates with the drive shaft 12. A clutch spring 58 is captured between a clutch spring retainer clip 60, held in a clutch spring retainer clip groove 61 on the drive shaft 12, and a top end of the hollow clutch sleeve 46. The clutch spring 58 constantly urges the hollow clutch sleeve 46 to the drive position of the screw driving device 10. A doughnut-shaped magnet 62 is received in a magnet socket 64 in the lower end of the depth adjustment sleeve 18. The magnet 62 magnetically attracts a steel screw (not shown) placed on the screw bit 26 so that the screw remains on the screw bit 26 until the screw is driven by the impact driver screw driving device 10.

The socket end 52 of the drive shaft 12 has a screw bit socket 66 which receives and retains the screw bit 26. As explained above, the screw bit socket 66 is pierced by the plurality of radial bores 54 (only one is shown in the cross-section). The radial bores 54 respectively receive a one of the clutch bearings 56 that respectively engage the flats on the hexagonal screw bit 26 when the screw driving mechanism 30 is in the drive position shown. The hollow clutch sleeve 46 has a hollow clutch sleeve groove 68 sized to receive a rounded outer end of the respective clutch bearings 56 when the screw driving mechanism 30 is in the clutched position, so that the clutch bearings 56 disengage the screw bit 26 but remain captured in the respective radial bores 54. A ball bearing 70 friction fit in an axial bore 72 in an upper end of the screw bit socket 66 supports a top end of the screw bit 26 to permit the screw bit 26 to remain stationary while the drive shaft 12 rotates freely when the screw driving device 10 is in the clutched position. A circlip 73 captured in a radial groove 74 in the end of the screw bit socket 66 engages notches 76 in the screw bit 26 to removably retain the screw bit 26 in the screw bit socket 66.

Figure 5:
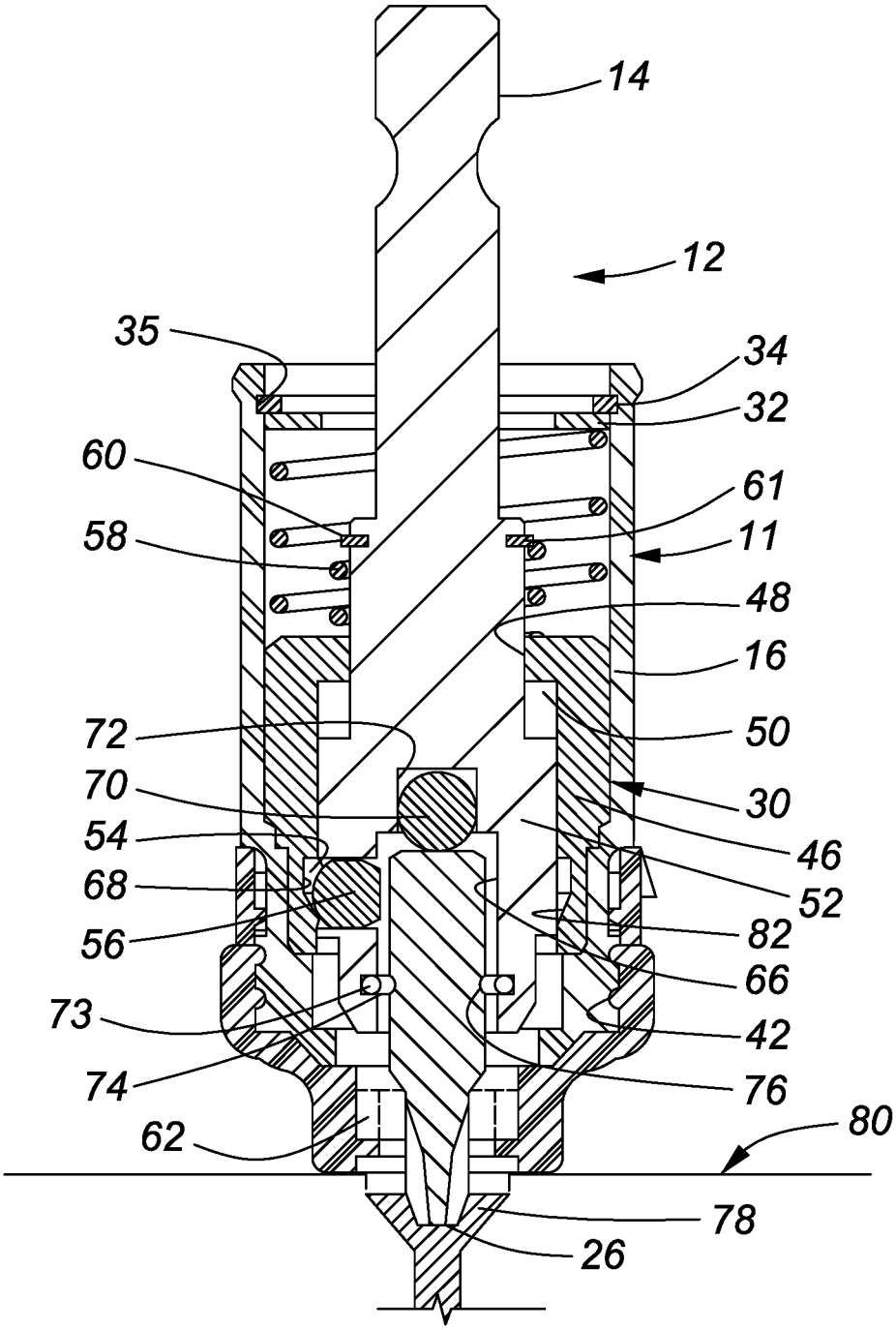
FIG. 5 is a cross-sectional view taken along lines 2-2 of FIG. 1 with the impact driver screw driving device in a clutch released position.

FIG. 5 is a cross-sectional view of the screw driving device 10 shown in the clutched position in which the screw bit 26 is released from driving engagement with the respective clutch bearings 56 so that a screw 78 is no longer driven by the screw driving mechanism 30. As the screw is driven into a work surface 80, the bottom end of the depth adjustment sleeve 18 contacts the work surface 80 and the drive shaft 12 slides downward through the central passage 48 of the hollow clutch sleeve 46 as the screw 78 is driven into the work surface 80 until the respective radial bores 54 align with the clutch sleeve groove 68 in the hollow clutch sleeve 46 and the respective clutch bearings 56 are forced outwardly into the clutch sleeve groove 68 by pressure exerted by the screw bit 26 as it engages the driven screw 78. Once the respective clutch bearings 56 enter the hollow clutch sleeve groove 68, they are no longer in contact with the respective flats on the screw bit 26 and the screw driving mechanism 30 is in the clutched position. Thus, even though the drive shaft 12 may continue to be rotated by the impact driver, the screw bit 26 remains stationary and the screw 78 is no longer driven. The depth to which the screw is driven into the work surface 80 is thereby controlled by the depth adjustment index 22 selected by an operator. When downward pressure on the drive shaft 12 is released by the operator of the impact driver, and the screw driving device 10 is moved away from the work surface 80, the clutch spring 58 urges the drive shaft 12 upwardly and the screw driving device 10 returns to the drive position shown in FIG. 4. As the screw driving device 10 returns to the drive position, an inclined bottom surface 82 of the clutch sleeve groove 68 forces the respective clutch bearings 56 back into contact with respective flats of the screw bit 26.

Figure 6:
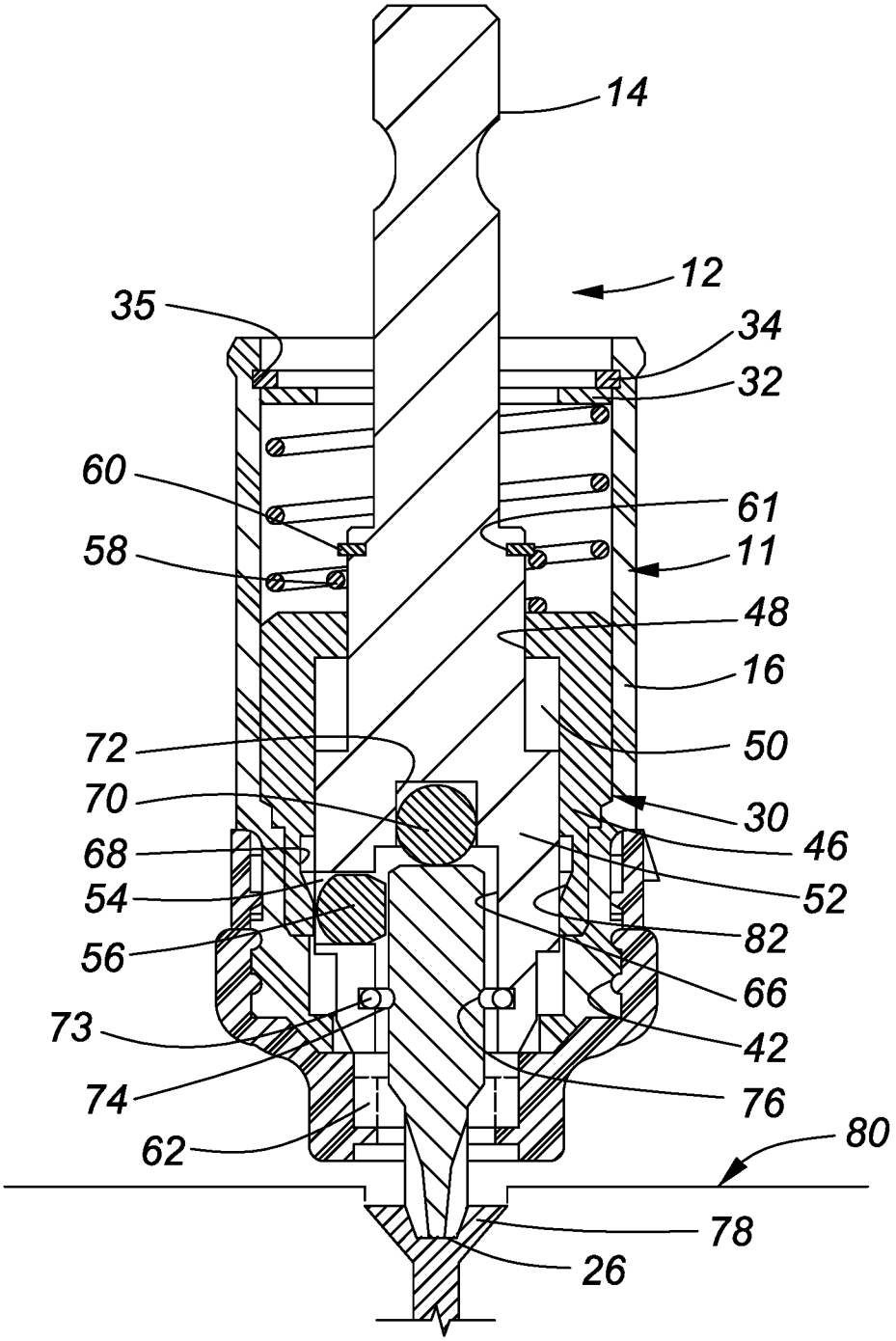
FIG. 6 is a cross-sectional view taken along lines 2-2 of FIG. 1 of the impact driver screw driving device in a bit-extended position used to extract a driven screw.

FIG. 6 is a cross-sectional view of the screw driving device 10 shown in FIG. 4 manually held in a reverse drive position typically used to extract a driven screw from a workpiece. In order to place the screw driving device 10 in the reverse drive position, the floating sleeve 16 is gripped by the operator and pulled upwardly against the bias of the clutch spring 58. In the reverse drive position, the respective clutch bearings 56 are below the clutch sleeve groove 68 in the hollow clutch sleeve 46 and engage respective flats on the screw bit 26, so that rotation of the drive shaft 12 in either direction rotates the screw bit in the same direction. This permits a driven screw 78 to be extracted from the work surface 80. Because the depth adjustment mechanism 11 rotates independently of the screw driving mechanism 30, the operator can hold the impact driver screw driving device 10 in the reverse drive position while extracting a screw for as long as necessary. This more can also be used to drive a screw deeper into the work surface 80, if desired.

The embodiments of the invention described above are intended to be exemplary only. The scope of the invention is therefore intended to be limited solely by the claims.

I claim:

1. An impact driver screw driving device with depth adjustment, comprising:

a screw driving mechanism that retains a screw bit for driving screws into a work surface, the screw driving mechanism comprising a drive shaft with a socket end received in a hollow clutch sleeve;

a floating sleeve that surrounds the screw driving mechanism;

a floating sleeve spring that provides a constant bias between an upper end of the floating sleeve and an upper end of the hollow clutch sleeve;

a depth adjustment sleeve threadedly connected to a bottom end of the floating sleeve, the depth adjustment sleeve having a bottom end with a passage through which the screw bit extends; and a clutch spring captured between a clutch spring retainer clip received in a clutch spring retainer clip groove on the drive shaft and a top of the hollow clutch sleeve, the clutch spring constantly urging the screw driving mechanism to a drive position.

2. The impact driver screw driving device with depth adjustment as claimed in claim 1 wherein the floating sleeve comprises a plurality of depth adjustment indexes, and the depth adjustment sleeve comprises a depth adjustment indicator that is manually displaceable by rotation of the depth adjustment sleeve on the floating sleeve to move the depth adjustment indicator from one depth adjustment index to another.

3. The impact driver screw driving device with depth adjustment as claimed in claim 2 wherein floating sleeve comprises a depth adjustment notch for each depth adjustment index, the respective depth adjustment notches being interleaved by respective depth adjustment ridges.

4. The impact driver screw driving device with depth adjustment as claimed in claim 3 wherein the depth adjustment sleeve further comprises a plurality of depth adjustment lock tabs that respectively engage a one of the depth adjustment notches in the floating sleeve.

5. The impact driver screw driving device with depth adjustment as claimed in claim 4 wherein the depth adjustment sleeve further comprises a slot between each of the depth adjustment lock tabs to facilitate movement of the respective depth adjustment lock tabs over the respective depth adjustment ridges.

6. The impact driver screw driving device with depth adjustment as claimed in claim 1 wherein the floating sleeve spring is retained in a top of the floating sleeve by a spring retainer washer and a washer retainer clip received in a retainer clip groove in a top of the floating sleeve.

7. The impact driver screw driving device with depth adjustment as claimed in claim 1 wherein the socket end of the drive shaft receives and retains the screw bit.

8. An impact driver screw driving device with depth adjustment, comprising:

a screw driving mechanism that retains a screw bit for driving screws into a work surface, the screw driving mechanism comprising a drive shaft with a socket end received in a hollow clutch sleeve, the socket end of the drive shaft receiving and retaining the screw bit;

a floating sleeve that surrounds the screw driving mechanism;

a floating sleeve spring that provides a constant bias between an upper end of the floating sleeve and an upper end of the hollow clutch sleeve, the floating sleeve spring being retained in a top of the floating sleeve by a spring retainer washer and a washer retainer clip received in a retainer clip groove in the upper end of the floating sleeve;

a depth adjustment sleeve threadedly connected to a bottom end of the floating sleeve, the depth adjustment sleeve having a bottom end with a passage through which the screw bit extends; and a clutch spring captured between a clutch spring retainer clip received in a clutch spring retainer clip groove on the drive shaft and a top of the hollow clutch sleeve, the clutch spring constantly urging the screw driving mechanism to a drive position.

9. The impact driver screw driving device with depth adjustment as claimed in claim 8 wherein the floating sleeve comprises a plurality of depth adjustment indexes, and the depth adjustment sleeve comprises a depth adjustment indicator that is manually displaceable by rotation of the depth adjustment sleeve on the floating sleeve to move the depth adjustment indicator from one depth adjustment index to another.

10. The impact driver screw driving device with depth adjustment as claimed in claim 9 wherein floating sleeve comprises a depth adjustment notch for each depth adjustment index, the respective depth adjustment notches being interleaved by respective depth adjustment ridges.

11. The impact driver screw driving device with depth adjustment as claimed in claim 10 wherein the depth adjustment sleeve further comprises a plurality of depth adjustment lock tabs that respectively engage a one of the depth adjustment notches in the floating sleeve.

12. The impact driver screw driving device with depth adjustment as claimed in claim 11 wherein the depth adjustment sleeve further comprises a slot between each of the depth adjustment lock tabs to facilitate movement of the respective depth adjustment lock tabs over the respective depth adjustment ridges.

13. An impact driver screw driving device with depth adjustment, comprising:

a screw driving mechanism that retains a screw bit for driving screws into a work surface;

a clutch spring that constantly urges the screw driving mechanism to a drive position;

a floating sleeve that surrounds the screw driving mechanism and the clutch spring;

a floating sleeve spring that surrounds the clutch spring and provides a constant bias between an upper end of the floating sleeve and an upper end of a hollow clutch sleeve of the screw driving mechanism; and a depth adjustment sleeve threadedly connected to a bottom end of the floating sleeve, the depth adjustment sleeve having a bottom end with a passage through which the screw bit extends.

14. The impact driver screw driving device with depth adjustment as claimed in claim 13 wherein the floating sleeve comprises a plurality of depth adjustment indexes, and the depth adjustment sleeve comprises a depth adjustment indicator that is manually displaceable by rotation of the depth adjustment sleeve on the floating sleeve to move the depth adjustment indicator from one depth adjustment index to another.

15. The impact driver screw driving device with depth adjustment as claimed in claim 14 wherein the floating sleeve comprises a depth adjustment notch for each depth adjustment index, the respective depth adjustment notches being interleaved by respective depth adjustment ridges.

16. The impact driver screw driving device with depth adjustment as claimed in claim 15 wherein the depth adjustment sleeve further comprises a plurality of depth adjustment lock tabs that respectively engage a one of the depth adjustment notches in the floating sleeve.

17. The impact driver screw driving device with depth adjustment as claimed in claim 16 wherein the depth adjustment sleeve further comprises a slot between each of the depth adjustment lock tabs to facilitate movement of the respective depth adjustment lock tabs over the respective depth adjustment ridges.

18. The impact driver screw driving device with depth adjustment as claimed in claim 13 wherein the floating sleeve spring is retained in a top of the floating sleeve by a clip received in a retainer clip groove in an upper end of the floating sleeve.

19. The impact driver screw driving device with depth adjustment as claimed in claim 13 wherein the screw driving mechanism comprises a drive shaft with a socket end received in the hollow clutch sleeve, the socket end of the drive shaft receiving and retaining the screw bit.

20. The impact driver screw driving device with depth adjustment as claimed in claim 19 wherein the clutch spring is captured between a clutch spring retainer clip received in a clutch spring retainer clip groove in the drive shaft and a top of the hollow clutch sleeve.

* * * * *